US005604399A

United States Patent [19]

Mandelman et al.

[11] Patent Number: 5,604,399

[45] Date of Patent: Feb. 18, 1997

[54] OPTIMAL GATE CONTROL DESIGN AND FABRICATION METHOD FOR LATERAL FIELD EMISSION DEVICES

[75] Inventors: Jack A. Mandelman, Stormville, N.Y.; Michael D. Potter, Grand Isle, Vt.

[73] Assignee: International Business Machines Corporation, Armonk, N.Y.

[21] Appl. No.: 470,320

[22] Filed: Jun. 6, 1995

[51] Int. Cl.[6] ..... H01J 1/62; H01J 63/04; H01J 1/46; H01J 1/42

[52] U.S. Cl. ..... 313/512; 313/306; 313/309; 313/310

[58] Field of Search ..... 313/306, 309, 313/310, 311, 336, 351, 512

[56] References Cited

U.S. PATENT DOCUMENTS

| | | | |
|---|---|---|---|
| 4,163,949 | 8/1979 | Shelton | 328/254 |
| 5,070,282 | 12/1991 | Epsztein | 315/383 |
| 5,079,476 | 1/1992 | Kane | 313/308 |
| 5,112,436 | 5/1992 | Bol | 156/643 |
| 5,136,764 | 8/1992 | Vasquez | 29/25.1 |
| 5,214,346 | 5/1993 | Komatsu | 313/390 |
| 5,214,347 | 5/1993 | Gray | 313/355 |
| 5,233,263 | 8/1993 | Cronin et al. | 313/309 |
| 5,268,648 | 12/1993 | Calcatera | 330/3 |
| 5,308,439 | 5/1994 | Cronin et al. | 156/656 |
| 5,312,777 | 5/1994 | Cronin et al. | 437/195 |

*Primary Examiner*—Louis M. Arana
*Assistant Examiner*—Mack Haynes
*Attorney, Agent, or Firm*—Heslin & Rothenberg, P.C.

[57] ABSTRACT

A lateral field emission device and method of fabricating the device which maximizes gate control of the cathode emitter electric field strength is disclosed. Gate control increases when the position of the gate edge is optimized with respect to the position of the emitter tip. Maximum control is achieved if the gate extends a distance beyond the emitter in the direction of the anode. Preferably, the displacement of the gate edge from the emitter tip is one half the cathode tip-anode distance for optimum control. The high gain device of the present invention provides improved transconductance.

12 Claims, 4 Drawing Sheets

OPTIMAL GATE CONTROL DESIGN AND FABRICATION METHOD FOR LATERAL FIELD EMISSION DEVICES

TECHNICAL FIELD

This invention relates in general to integrated microelectronic devices having a field emission cathode structure. More particularly, the invention relates to lateral field emission device structures and methods of fabricating the same.

BACKGROUND OF THE INVENTION

Field emission devices (FEDs) or micro-vacuum tubes have gained recent popularity as alternatives to conventional semiconductor silicon devices. Advantages associated with the use of FEDs include faster switching in the terahertz regime, temperature and radiation insensitivity, and relative ease in fabrication. Applications range from discrete active devices to high density SRAMs and displays, radiation-hardened military applications, and temperature insensitive space technologies, for example. The literature on field emission devices focuses principally on process problems associated with producing the sharpest tip (e.g., with photolithography), controlling cathode to anode and cathode to gate distances, and achieving self-alignment between these elements. In many known vertical FEDs, the sharply pointed tip of the cathode is the only physical structure that is not commonly produced by standard integrated circuit fabrication processes.

Recently, lateral field emission devices have emerged as an alternative to traditional vertical emitter devices. U.S. Pat. Nos. 5,233,263 and 5,308,439 to Cronin et al. describe lateral field emission devices in which conventional integrated circuit fabrication techniques are used to produce the devices. A horizontal thin-film cathode is disclosed wherein the cathode emitter tip is separated from an anode by a predetermined distance. The anode receives electrons emitted horizontally by field emission from the tip of the cathode. For significant electron tunneling to take place at the tip of the emitter, the electric field at the tip must reach a relatively high strength (e.g., $1\times10^7$V/cm).

The electric field produced at the cathode tip determines the electron density emitted by the cathode which in turn determines the current of the device. The magnitude of the cathode electric field is partially controlled by varying the applied voltage to gates disposed above and/or below the cathode. Changes in the gate voltage will cause corresponding changes in the electric field. Because the device output current changes exponentially with changes in the cathode electric field, even small changes in the electric field strength will produce high gains in the device.

For a given gate voltage the strength of the electric field produced between the emitter tip and the anode can additionally be controlled by varying such geometric factors as the horizontal distance between the cathode emitter and the anode (gap spacing) and the vertical insulator spacing between the gate and the emitter. The smaller the gap between the emitter and the anode, the stronger the electric field produced. In addition, when the vertical distance between the cathode and the gate is minimized (i.e. when the thickness of the insulator separating the emitter and the gate is minimized), an electric field of increased strength will result for a given gate voltage.

Electrons emitted from the emitter tip will often be collected on parts of the gate electrode. Such collections increase in frequency with the positive voltage (with respect to the emitter electrode) that must be placed on the gate electrode to get the device to function. As a result, the number of electrons that reach the anode is reduced, and the efficiency and transconductance of the device is lowered. For a given applied voltage, Cronin et al. teaches in the aforementioned patents that the electric field can be further increased by terminating the cathode tip in the same vertical plane as the gate edge such that the vertical plane is orthogonal to the upper surface of the underlying substrate. Electron collisions with the gate electrode are therefore minimized. In addition, the smaller the radius of curvature of the projecting emitter tip, the lower will be the gate voltage necessary to initiate electron flow (threshold voltage).

In summary, the requisite emitter electric field of lateral field emission devices, and, thus, the current of the device is somewhat controllable by the gate voltage by optimizing the aforementioned parameters during fabrication. Additional control of device current through the design of a high gain structure is desirable. An optimized device structure is desired wherein the change in anode current for a given change in gate voltage is substantially increased, while maintaining acceptable current.

SUMMARY OF THE INVENTION

The present invention provides a lateral field emission device structure and a method of fabricating the device that increases control of the electric field strength by optimizing the position of the gate electrode relative to the emitting portion of the cathode. Gate control of the emitted electron density is maximized if the gate extends a distance beyond the emitter in the direction of the anode. The optimum gate position is dependent upon geometric factors such as the thickness of the gate to emitter insulator, emitter to anode spacing, and gate to anode spacing. Preferably, the displacement of the gate edge from the emitter tip is one half the emitter-anode distance. The gate position of the field emission device of the present invention increases the change in peak electric field for a given change in gate potential, which defines the gain or amplification of the device, while maintaining acceptable anode current.

Briefly described, in one aspect of the present invention, a novel lateral field emission device is provided which includes a cathode member disposed to extend parallel to the upper surface of a substrate. At least one end of the cathode member includes a tip for emitting electrons by field emission. An anode member is positioned on the substrate so as to be exactly a preselected horizontal distance from the tip of the cathode member. The anode member receives electrons emitted by field emission from the tip of the cathode member. A gate member for controlling emission of the electrons from the emitter tip is disposed beneath and extends laterally beyond the tip of the cathode member toward the anode member. The edge of the gate member is horizontally displaced from the tip of the cathode member. The gate member is also a preselected horizontal distance from the anode member which is less than that of the cathode member from the anode member. For optimal tradeoff between control of the cathode electric field and magnitude of electric field, the gate member is preferably positioned at a point halfway between the cathode emitter tip and the anode.

In another aspect of the present invention, the lateral field emission device includes a first metallic layer, or gate electrode, disposed so as to extend parallel over the upper surface of a substrate. A first insulating layer overlies the gate electrode separating it from a second metallic layer, or cathode emitter, disposed on the first insulating layer. The cathode emitter overlies a portion of the gate which extends laterally beyond the cathode emitter toward a third metallic layer, or anode. The anode is disposed on the substrate and is laterally spaced a first distance from the edge of the gate and a second distance from the cathode emitter tip. The cathode-anode distance is greater than that from the gate to the anode, preferably by a factor of two. The height of the anode from the substrate is at least equal to the combined heights from the substrate of the cathode, gate, and intervening first insulating layer. The gate controls electron emission from the cathode to the anode. Finally a passivation layer overlies the cathode. In one embodiment of the device, the gate and first insulating layer terminate in the same first vertical plane, which is orthogonal to the upper surface of the substrate and spaced the first distance from the anode. Alternatively in another embodiment, the passivation layer, cathode, and first insulating layer terminate in the same second vertical plane, which is also orthogonal to the upper surface of the substrate and spaced the second distance from the anode.

In another aspect, the present invention comprises a method for fabricating a lateral field emission device which includes the steps of:

(a) depositing a first metallic layer onto the upper surface of a substrate, said first metallic layer extending parallel to the upper surface of said substrate;

(b) depositing a first insulating layer onto said first metallic layer;

(c) depositing a second metallic layer onto said first insulating layer;

(d) depositing a second insulating layer onto said second metallic layer;

(e) providing an opening through said second insulating layer, said second metallic layer, said first insulating layer, and said first metallic layer;

(f) depositing a first sacrificial layer of material on the walls of said opening provided in step (e), said first sacrificial layer being of predetermined width;

(g) filling said opening at least partially with a third metallic layer such that said first sacrificial layer spaces said third metallic layer from said first and second metallic layers, said predetermined first sacrificial layer width equaling a desired spatial distance between said first and third metallic layers;

(h) removing a portion of said second insulating layer adjacent to said first sacrificial layer and exposing said second metallic layer and a sidewall of said first sacrificial layer;

(i) depositing a second sacrificial layer of material of predetermined width onto said sidewall of said first sacrificial layer and onto a portion of said exposed second metallic layer, said portion being adjacent to said first sacrificial layer and having said predetermined width;

(j) depositing a passivation layer onto said exposed second metallic layer adjacent to said second sacrificial layer;

(k) removing said first sacrificial layer to form a first space;

(l) removing said second sacrificial layer to form a second space and to expose a portion of said second metallic layer directly beneath said second space; and (m) removing said exposed portion of said second metallic layer, said remaining second metallic layer being laterally displaced from said third metallic layer by a second distance equal to the combined horizontal widths of said first and second spaces, said first metallic layer being laterally displaced from said third metallic layer by a first distance equal to the horizontal width of said first space, said first metallic layer being operable to control electron emission from said second metallic layer to said third metallic layer.

The first metallic layer functions as the gate electrode for the triode field emission device, whereas the second metallic layer is the cathode, and the third metallic layer is the anode. The third metallic layer, or anode, created by filling step (g) has a minimum height measured from the upper surface of the substrate approximately equal to the combined heights of the first metallic layer, second metallic layer (gate and cathode) and the first insulating layer. In an alternative configuration, the fabrication method further comprises the step of removing a portion of the first insulating layer directly beneath the removed second metallic layer. Optimum control of electron emission from the cathode is achieved if the width of the first space equals the width of the second space such that the lateral displacement of the cathode from the edge of the gate electrode is half the distance between the cathode and the anode.

The present lateral field emission device in which the edge of the gate electrode is positioned between the anode and the cathode has significant advantages over prior structures. Although some control over the magnitude of the cathode emitter electric field produced for variations in gate potential was previously possible by varying many geometric fabrication factors, the strength of the electric field can be further controlled by displacing the gate from the cathode edge. The structure and method for fabrication of the present invention provides a device having improved transconductance.

The foregoing and other objects, features, and advantages of the invention will be apparent from the following more particular description of the preferred embodiments of the invention as illustrated in the accompanying drawings.

BEST MODE FOR CARRYING OUT THE INVENTION

As noted, the lateral field emission device and method of producing the device of the present invention increases gate control of the emitted current by selecting the position of the gate relative to the emitting portion of the cathode emitter. By adjusting the horizontal position of the gate between the emitter tip and the anode, increased control of the strength of the emitter electric field is possible. Optimum tradeoff between control and emitted current is attained when the gate edge is positioned approximately half way between the cathode emitter tip and the anode.

Reference should now be made to the drawings in which the same reference numbers are used throughout the different figures to designate the same or similar components.

Figure 1:
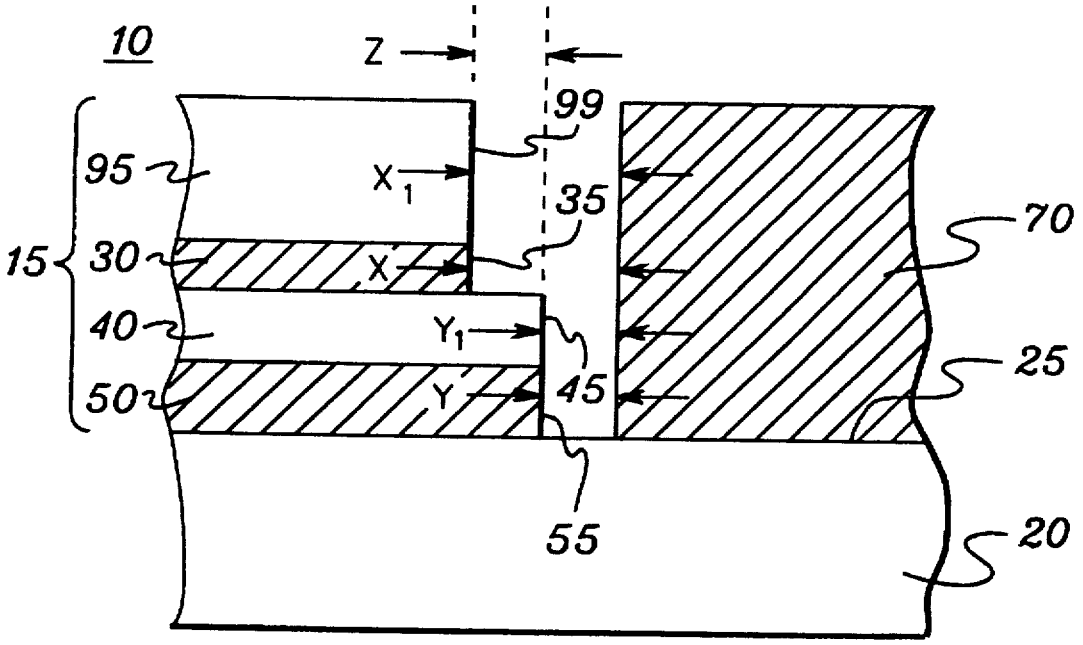
FIG. 1 is a cross-sectional view illustrating a lateral field emission device in accordance with an embodiment of the present invention.
Figure 2:
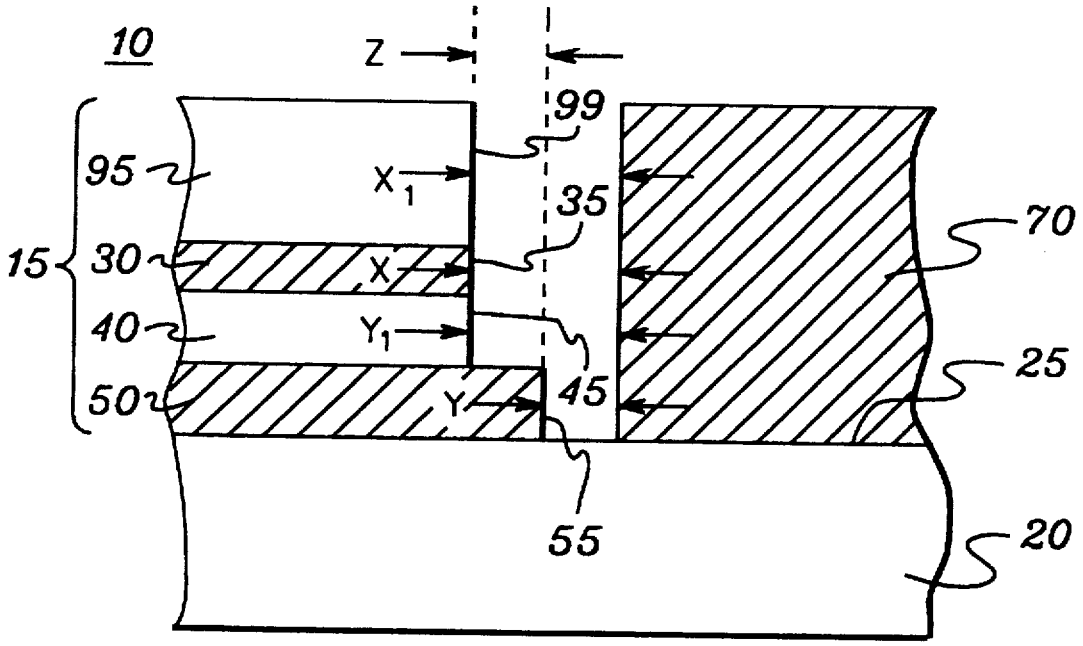
FIG. 2 is a cross-sectional view illustrating a lateral field emission device in accordance with an alternative embodiment of the present invention.

The preferred embodiments of a lateral field emission device (FED) pursuant to the present invention, generally denoted 10, are depicted in cross-section in FIGS. 1 and 2. Additional fabrication steps to electrically couple cathode member 30 to the upper surface of FED 10 are described in U.S. Pat. Nos. 5,233,263 and 5,308,439 to Cronin et al., mentioned above, which are hereby incorporated herein by reference.

Substrate 20 of the FEDs of FIGS. 1 and 2 can comprise any glass, ceramic, etc. capable of withstanding the elevated temperatures (e.g., 450°C.) typically encountered during the device fabrication process described below. An electron emitter cathode member 30 is disposed laterally relative to upper surface 25 of supporting substrate 20. Electron emitter cathode member 30 preferably comprises a thin film of tungsten or titanium nitride, for example, which is about 100–200 Å thick. It should be understood that other metals could be successfully applied to form cathode 30 such as tantalum, molybdenum, titanium, aluminum, or alloys thereof. Chemical vapor deposition or sputtering techniques, for example, may be used to produce cathode 30.

First insulating layer 40 comprising an oxide such as silicon dioxide separates lower gate member 50 from cathode member 30 and, in particular, separates tip 35 of cathode 30 from gate 50. The thickness of first insulating layer 40 is preferably one half the horizontal distance "x" between cathode tip 35 and anode 70 (see below) and is approximately between about 200 and 1000 Å depending on the design of the device. This thickness is minimized to obtain low device turn on voltage. Gate member 50 comprises a conductive metal, preferably tungsten or an aluminum-copper alloy. The thickness of gate member 50 is not critical to emitter electric field control and can be selected for optimization of device characteristics. Typically, gate member 50 has a thickness between about 100 and 1000 Å.

Passivation layer 95, preferably comprising silicon dioxide, is disposed over cathode member 30 to protect cathode member 30 and other circuitry that may be in the vicinity of FED 10. Passivation layer 95 must be thick enough to prevent unwanted capacitive coupling between cathode 30 and any other nearby conductor and is typically between about 1000 and 3000 Å thick.

Anode member 70, typically comprising a conductive metal such as tungsten or an aluminum-copper alloy, is disposed on substrate 20 and spaced from the opposing laterally extending cathode/gate stack 15. However, other embodiments are possible. For example, in a light emitting device, the anode could be comprised of a phosphor layer and a metal layer, such that light is emitted when electrons are transmitted from the cathode to the phosphor.

The space between cathode/gate stack 15 and anode 70 preferably comprises a vacuum (e.g., $10^{-6}$ to $10^{-7}$ torr). However, a vacuum is not necessary to the invention, and the space could be filled with any gas, such as helium or air, or an insulator.

For a given change in the gate voltage, the maximum corresponding change in the peak electric field is desirable to maximize the device gain. Thus, by varying the gate voltage, the electric field can be controlled. In accordance with the present invention, additional control of the emitter electric field and device current is possible by increasing the lateral displacement "z" of gate edge 55 with respect to emitter tip 35. Thus, the emitter electric field and hence the device current has a stronger dependence on a change in gate voltage when the displacement "z" is optimized than would be expected from the art.

Increased gate control of the emitter electric field is provided when the horizontal distance "x" between cathode 30 and anode 70 is greater than the horizontal distance "y" between gate 50 and anode 70 such that gate edge 55 is between anode 70 and emitter tip 35. Distance "x" is preferably between about 400 and 2000 Å.

If, instead, gate edge 55 is further away from anode 70 than emitter tip 35 is from anode 70, gate 50 has minimal effect on the electron emission because in that case only gate fringing fields will affect the magnitude of the emitting electric field. However, if the gate to anode space "y" is much less than the emitter to anode space "x" then the electric field of gate 50 terminates in anode 70 and has a reduced effect on emitter tip 35. The optimum tradeoff between gate control and electric field is obtained when displacement "z" is approximately one half the emitter-anode gap "x" or alternatively stated, the gate-anode distance "y" is approximately one half the emitter-anode gap "x".

Figure 8:
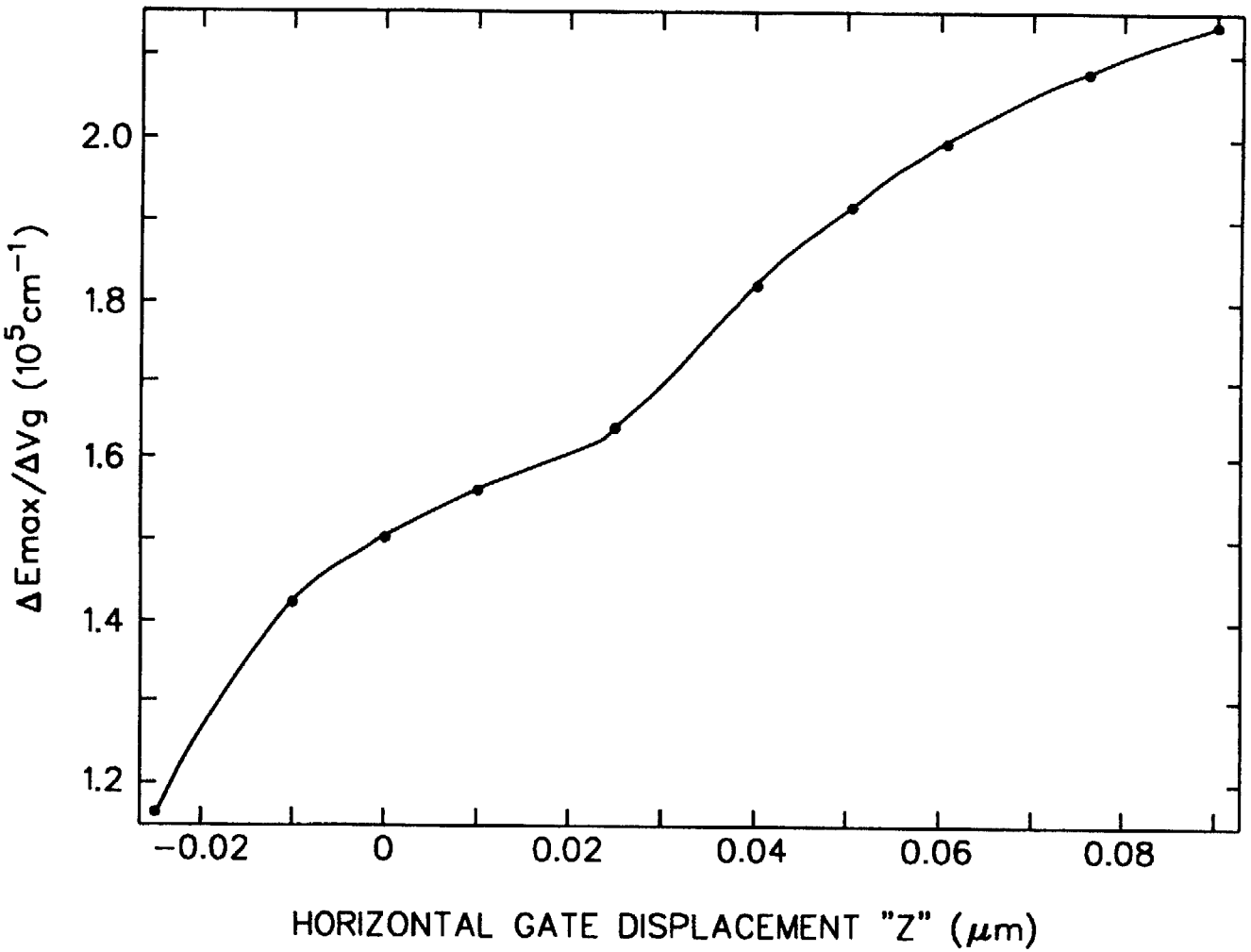
FIG. 8 is a plot of the change in the maximum electric field per unit change in gate voltage against the horizontal displacement of the gate edge from the emitter tip which illustrates gate control.

To illustrate, FIG. 8 provides an example of how gate control varies by showing the change in the maximum electric field ($\Delta E_{max}$) per unit change in gate voltage ($\Delta V_g$) against the displacement "z" of gate edge 55 relative to cathode emitter tip 35. In this example, the cathode emitter-anode space "x" is 1000 Å, and the thickness of intervening first insulating layer 40 is 510 Å. The anode potential is 40 V, and the gate potential varies between 0 and 5 V. The displacement "z" that was investigated ranged from about—250 Å to about 900 Å. As shown in the graph, as the distance between gate edge 55 and emitter tip 35 increases, the slope, which is a measure of control over the strength of the electric field, also increases. $\Delta E_{max}/\Delta V_g$, vs. "z" departs from linearity since the location of the peak electric field changes slightly with "z". The maximum control is obtained when the displacement "z" is about 500 Å, or when gate edge 55 is approximately half way between emitter tip 35 and anode 70. As the displacement "z" increases to half way between emitter tip 35 and anode 70, the peak electric field decreases by <9%. This represents an acceptable tradeoff between gate control and device current.

Edge 99 of passivation layer 95 terminates in the same vertical plane as emitter tip 35 such that emitter-anode gap "x" equals the second insulating layer-anode distance "$x_1$". This vertical plane is orthogonal to upper surface 25 of substrate 20.

Shown as one embodiment of the present invention in FIG. 1, edge 45 of first insulating layer 40 terminates in the same vertical plane as gate edge 55 such that the gate-anode distance "y" is the same as the first insulating layer-anode distance "$y_1$". This vertical plane is orthogonal to upper surface 25 of substrate 20. Alternatively, as shown in FIG. 2, edge 45 of first insulating layer 40 terminates in the same vertical plane as emitter tip 35 and passivation layer edge 99. In this embodiment, emitter-anode distance "x" passivation layer-anode gap "$x_1$" and first insulating layer-anode distance "y" are all equal. The embodiment chosen will depend on the desired device characteristics which are in part due to the permittivity of first insulating layer 40 and the vacuum or air gap in the vicinity of emitter tip 35 and bottom gate 50. If desired, the gap may be filled with a dielectric.

Figure 3:
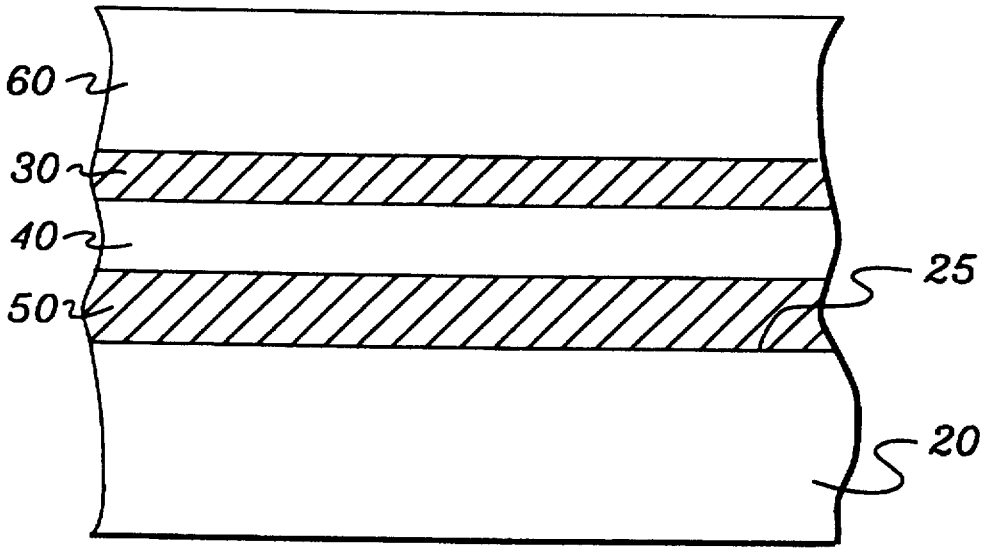
FIG. 3 is a cross-sectional view of a microelectronic assembly subsequent to the steps of depositing a bottom gate electrode, a first insulating layer, an emitter, and a second insulating layer, in the fabrication process of the FEDs of FIGS. 1 or 2 pursuant to the present invention.

As shown in FIG. 3 fabrication of device 10 begins by depositing a conductive metal such as tungsten or an aluminum-copper alloy onto upper surface 25 of substrate 20 to form first metallic layer 50, which will become the gate electrode. Generally, chemical vapor deposition will be used to deposit the metal.

The next fabricated layer is first insulating layer 40, typically comprising an oxide such as silicon dioxide, which is deposited onto first metallic layer 50. This layer is preferably between about 200 Å and 1000 Å and separates gate 50 from the cathode member which is formed next. Second metallic layer 30, which will become the cathode emitter electrode, is deposited as a thin film of between about 100 and 200 521 onto first insulating layer 40, typically by chemical vapor deposition. Second metallic layer 30 preferably comprises tungsten or titanium nitride, for example. Second insulating layer 60 comprising silicon dioxide, for example, is then deposited onto second metallic layer 30.

Figure 4:
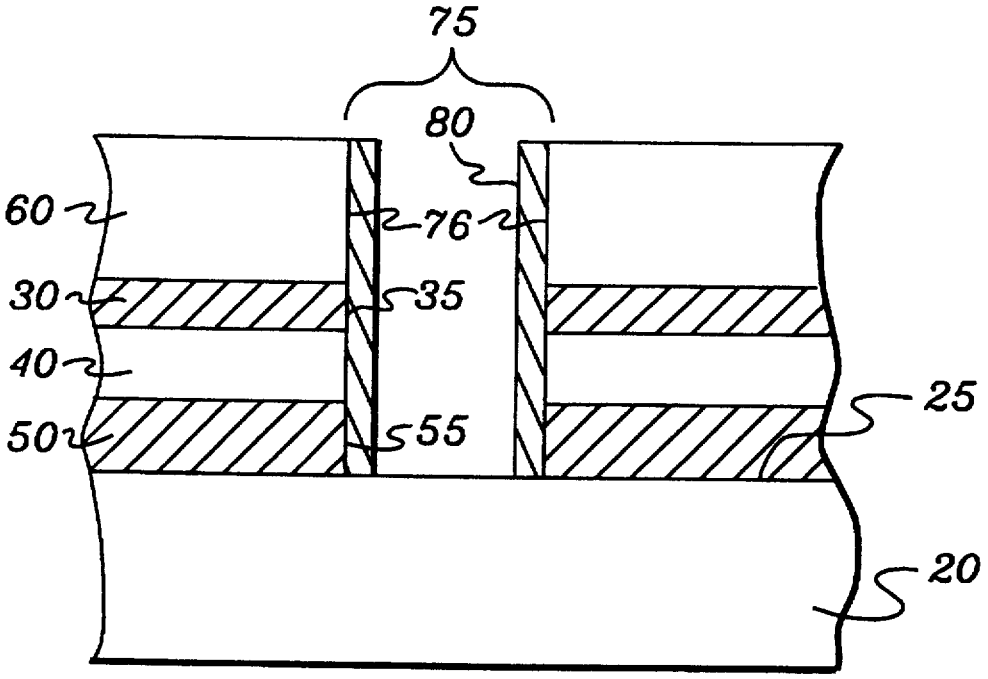
FIG. 4 is a cross-sectional view of the microelectronic assembly of FIG. 3 subsequent to the steps of providing an opening therein and depositing a first sacrificial layer on the opening walls pursuant to the fabrication process of the present invention.

As shown in FIG. 4, opening 75 for definition of the anode (not shown) is then provided through second insulating layer 60, second metallic layer (emitter electrode) 30, first insulating layer 40, and first metallic layer (gate electrode) 50 to upper surface 25 of substrate 20. Masking (e.g., with a photoresist) followed by reactive ion etching is typically used to create opening 75, but other etching processes may be used to define opening 75. Those skilled in the art will be familiar with what processes are available for forming opening 75, and the invention is not limited by the particular masking and etching approaches used at any of the fabrication stages discussed herein. The aforementioned etching to define opening 75 simultaneously aligns gate edge 55 with emitter tip 35.

Prior to formation of the anode, a thin conformal layer (not shown) of a spacer material such as parylene or silicon nitride, for example, is deposited over second insulating layer 60 and on the bottom and sidewalls 76 of opening 75. The thickness of this conformal layer is very exactly controlled since it will constitute the distance "y" between the gate electrode and anode. (See FIGS. 1 and 2). Typical spacer material thickness is about 500 Å. Thereafter, a unidirectional etch, such as reactive ion etching, removes all spacer material extending horizontally above oxide layer 60, and on the floor of opening 75, while retaining first sacrificial layer 80 on walls 76 of opening 75.

Figure 5:
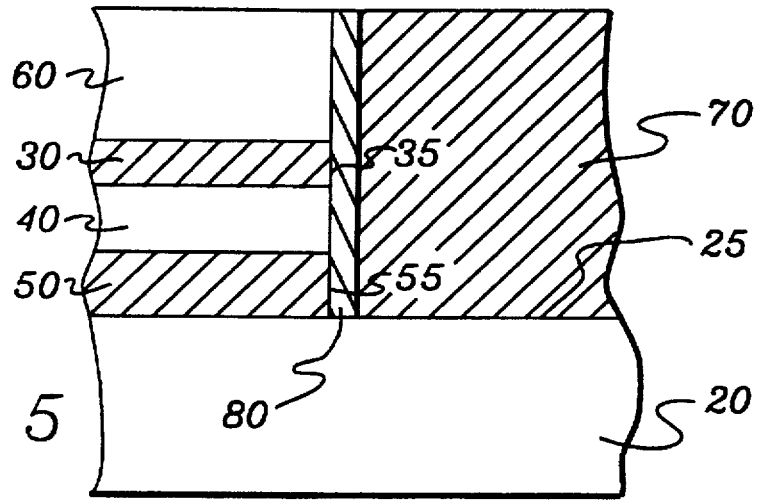
FIG. 5 is a cross-sectional view of the microelectronic assembly of FIG. 4 subsequent to formation of the anode pursuant to the fabrication process of the present invention.

Next, as shown in FIG. 5 third metallic layer 70, preferably comprising tungsten-or an aluminum-copper alloy, is deposited into the remaining opening to form the anode. Deposition of the metal is typically done by chemical vapor deposition. Third metallic layer 70 is then planarized to a level even with second insulating layer 60.

Second insulating layer 60 over second metallic layer (emitter) 30 and adjacent to first sacrificial layer 80 is removed by suitable means such as masking and etching to expose emitter 30 and sidewall 81 of first sacrificial layer 80. A second conformal layer (not shown) comprising spacer material such as parylene or silicon nitride is deposited onto exposed second metallic layer 30, onto sidewall 81, over first sacrificial layer 80, and onto anode 70. The thickness of this deposited conformal layer is very exactly controlled by conventional deposition parameters, such as flow rates of the reactants, time, temperature, and pressure, for example, since it will constitute the distance "z" between cathode emitter tip 35 and gate edge 55. Thereafter, a unidirectional etch, such as reactive ion etching, removes all spacer material extending horizontally above second metallic layer 30, first sacrificial layer 80, and anode 70, while retaining second sacrificial layer 90 on sidewall 81 of first sacrificial layer 80. (See FIG. 6) Typically, the horizontal width of second sacrificial layer 90, or the horizontal distance "z" is about 500 Å for a final FED 10 configuration having an emitter-anode distance "x" equal to 1000 Å.

Figure 6:
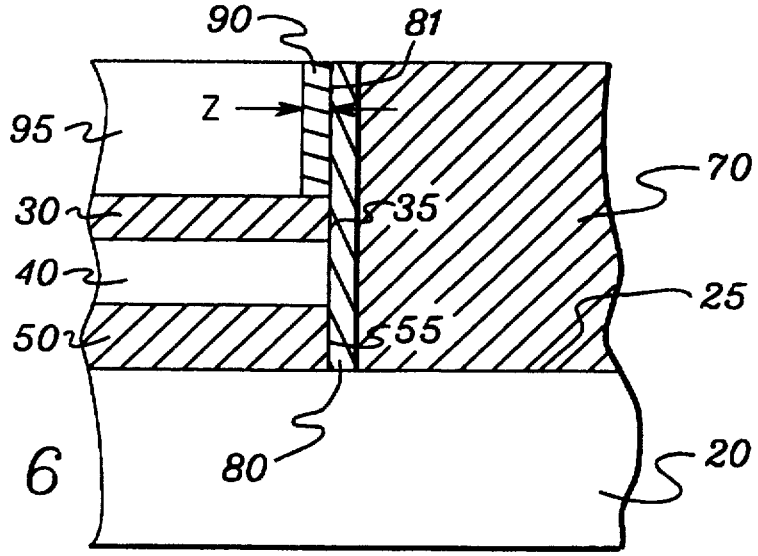
FIG. 6 is a cross-sectional view of the microassembly of FIG. 5 subsequent to the steps of depositing a second sacrificial layer and a passivation layer pursuant to the fabrication process of the present invention.

As shown in FIG. 6, passivation layer 95 comprising silicon dioxide, for example, is deposited onto exposed second metallic layer 30 for protection and is planarized using chemical mechanical polishing, for example, to a level even with the upper surfaces of first sacrificial layer 80, second sacrificial layer 90, and anode 70.

Figure 7:
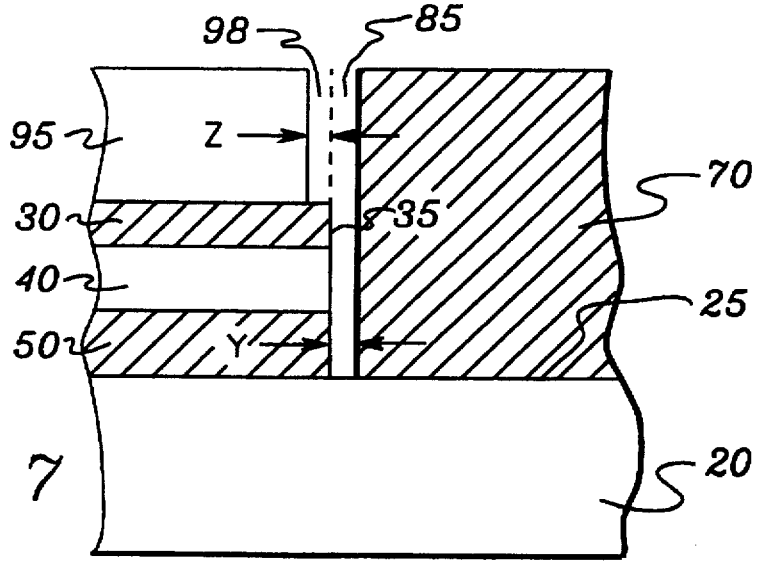
FIG. 7 is a cross-sectional view of the microelectronic assembly of FIG. 6 subsequent to the steps of forming a first and second space pursuant to the fabrication process of the present invention.

AS shown in FIG. 7, first sacrificial layer 80 and second sacrificial layer 90 are then removed to form first space 85 having a horizontal width "y" and second space 98, which extends laterally a distance "z" from gate edge 55. A conventional removal process such as oxygen plasma ashing is employed. The FED of FIG. 1 is formed upon further etching to remove underlying second metallic layer 30 directly beneath second space 98. The aforementioned etching defines emitter tip 35 simultaneously aligned with passivation edge 99. Resulting emitter edge 35 is also laterally displaced from gate edge 55 by distance "z". Subsequent removal of a portion of underlying first insulating layer 40 directly beneath the removed emitter 30 results in the fabrication of an alternative embodiment of the FED shown in FIG. 2.

Referring to FIGS. 1 and 2, a vacuum may then be created in the space between cathode/gate stack 15 and anode member 70 after removal of the parylene of first sacrificial layer 80, second sacrificial layer 90, underlying emitter 30, and underlying first insulator layer 40 (optional). The gap may optionally be filled with a dielectric material.

The field emission device may be patterned for disposition of separate metallization contacts to emitter 30, gate 50, and anode 70 for the subsequent application of electrical biasing voltages to each of the electrodes. Operationally, when a voltage potential of sufficient magnitude is applied between the emitter and the anode, electrons are directly injected horizontally from the emitter to the anode. Because emitter 30 comprises a thin-film metallization layer, the radius of curvature across tip 35 of emitter 30 is small enough to create the high electric field necessary for operation of the FED.

Variations to configuration 10, such as a display element with improved gate control of the emitting electric field, may be fabricated using the additional fabrication steps described in U.S. Pat. Nos. 5,233,263 and 5,308,439. In addition, a single integrated structure having multiple cathodes and multiple gates for controlling current density may be fabricated using the method of the present invention to perform various logic operations and/or enhance current output from the device.

The lateral field emission device of the present invention, wherein the edge of the gate is between the emitter and the anode, is advantageous over previous structures because it allows greater gate control of the electric field at the emitter. The emitter electric field and hence the device current has a stronger dependence on a change in gate voltage than that of the prior art devices. Significant improvements over current control can be obtained. Thus, the tradeoff between gate control of output current and output current can be optimized by selecting the position of the gate with respect to the cathode.

Although at a given gate voltage, such as 10 V, for example, there is a small reduction (<9%) in the maximum emitter electric field as the gate displacement "z" increases from 0 to one half the emitter-anode gap "x" this effect is greatly outweighed by the benefit of the much greater gate control of the electric field. Improvements in gate control of the emitting electric field are greatly amplified because current density is a very strong function of the electric field. Thus, the field emission device of the present invention provides an improvement in transconductance and performance over prior structures by providing an additional parameter for improving control of electron emission.

While the invention has been particularly shown and described with reference to the preferred embodiments thereof, it will be understood by those skilled in the art that other changes in form and details may be made therin without departing from the spirit and scope of the invention.

I claim:

1. A lateral field emission device comprising:

a substrate having an upper surface;

an electron emitter cathode member disposed relative to said substrate so as to extend parallel to said upper surface of said substrate, at least one end of said cathode member having a tip for emitting electrons by field emission;

a gate member for controlling emission of electrons from said tip of said electron emitter cathode member tip, said gate member disposed beneath and extending laterally beyond said cathode member tip; and an anode member for receiving electrons emitted by field emission from the tip of said cathode member, said anode member positioned on said substrate and spaced a predetermined first distance from said gate member and a predetermined second distance from the tip of said emitter cathode member, said second distance being between about 400 and about 2000 Å and greater than said first distance so that said gate member ends in an edge positioned between said cathode member tip and said anode.

2. The field emission device of claim 1, wherein said first distance equals one half said second distance and is between about 200 and 1000 Å.

3. A lateral field emission device comprising:

a substrate having an upper surface;

a first metallic layer disposed relative to said substrate so as to extend parallel to said upper surface of said substrate;

a first insulating layer overlying said first metallic layer;

a second metallic layer disposed on said first insulating layer so as to overlie a portion of said first metallic layer, said first metallic layer extending laterally beyond said second metallic layer;

a third metallic layer disposed on said substrate, said third metallic layer being spaced laterally a first distance from said first metallic layer and a second distance from said second metallic layer, said second distance being between about 400 and about 2000 Å and greater than said first distance, so that said first metallic layer terminates between said second metallic layer and said third metallic layer, said first metallic layer being operable to control a horizontal electron emission from said second metallic layer to said third metallic layer;

said third metallic layer having a height from said substrate at least equal to the combined height from said substrate of said first and second metallic layers and said first insulating layer disposed there between; and a passivation layer overlying said second metallic layer.

4. The field emission device of claim 3, wherein said first metallic layer comprises a gate control for said second metallic layer.

5. The field emission device of claim 4, wherein said first distance equals one half said second distance.

6. The field emission device of claim 4, wherein said first insulating layer has a thickness equal to one half said second distance.

7. The field emission device of claim 4, wherein said first metallic layer and said first insulating layer terminate in the same first vertical plane, said first vertical plane being orthogonal to said upper surface of said substrate and spaced said first distance from said third metallic layer.

8. The field emission device of claim 4, wherein said passivation layer, said second metallic layer, and said first insulating layer terminate in the same second vertical plane, said second vertical plane being orthogonal to said upper surface of said substrate and spaced said second distance from said third metallic layer.

9. A method of fabricating a lateral field emission device, said method comprising the steps of:

(a) depositing a first metallic layer onto the upper surface of a substrate, said first metallic layer extending parallel to the upper surface of said substrate;

(b) depositing a first insulating layer onto said first metallic layer;

(c) depositing a second metallic layer onto said first insulating layer;

(d) depositing a second insulating layer onto said second metallic layer;

(e) providing an opening through said second insulating layer, said second metallic layer, said first insulating layer, and said first metallic layer;

(f) depositing a first sacrificial layer of material on the walls of said opening provided in step (e), said first sacrificial layer being of predetermined width;

(g) filling said opening at least partially with a third metallic layer such that said first sacrificial layer spaces said third metallic layer from said first and second metallic layers, said predetermined first sacrificial layer width equaling a desired spatial distance between said first and third metallic layers;

(h) removing a portion of said second insulating layer adjacent to said first sacrificial layer and exposing said second metallic layer and a sidewall of said first sacrificial layer;

(i) depositing a second sacrificial layer of material of predetermined width onto said sidewall of said first sacrificial layer and onto a portion of said exposed second metallic layer, said portion being adjacent to said first sacrificial layer and having said predetermined width;

(j) depositing a passivation layer onto said exposed second metallic layer adjacent to said second sacrificial layer;

(k) removing said first sacrificial layer to form a first space;

(l) removing said second sacrificial layer to form a second space and to expose a portion of said second metallic layer directly beneath said second space; and (m) removing said exposed portion of said second metallic layer, said remaining second metallic layer being laterally displaced from said third metallic layer by a second distance equal to the combined horizontal widths of said first and second spaces, said first metallic layer being laterally displaced from said third metallic layer by a first distance equal to the horizontal width of said first space, said first metallic layer being operable to control electron emission from said second metallic layer to said third metallic layer.

10. The fabrication method of claim 9, wherein said filling step (g) produces a third metallic layer having a height from the upper surface of said substrate approximately the same as the combined height of said first metallic layer, said second metallic layer, and said first insulating layer measured from the upper surface of said substrate.

11. The fabrication method of claim 9, further comprising the step of removing a portion of said first insulating layer directly beneath said removed second metallic layer.

12. The fabrication method of claim 9, wherein the horizontal width of said first space equals the horizontal width of said second space.

* * * * *